US006561486B2

(12) United States Patent
Haney et al.

(10) Patent No.: US 6,561,486 B2
(45) Date of Patent: May 13, 2003

(54) MOTORIZED SUPPORT JACK

(75) Inventors: Steven J. Haney, Tracey, CA (US); Donald Joe Herron, Manteca, CA (US)

(73) Assignee: EUV LLC, Santa Clara, CA (US)

( * ) Notice: Subject to any disclaimer, the term of this patent is extended or adjusted under 35 U.S.C. 154(b) by 0 days.

(21) Appl. No.: 09/976,919

(22) Filed: Oct. 11, 2001

(65) Prior Publication Data

US 2002/0027221 A1 Mar. 7, 2002

Related U.S. Application Data

(62) Division of application No. 09/568,611, filed on May 10, 2000, now Pat. No. 6,328,282.

(51) Int. Cl.[7] ..... B66F 1/00
(52) U.S. Cl. ..... 254/1; 254/104
(58) Field of Search ..... 254/104, 98, 103, 254/100, 1; 269/234, 217

(56) References Cited

U.S. PATENT DOCUMENTS 4,789,133 A 12/1988 Liaw
5,172,601 A 12/1992 Siegrist et al.
5,967,728 A 10/1999 Gales et al.
5,992,826 A 11/1999 Simmonds
6,042,097 A 3/2000 Ikawa et al.
6,241,214 B1 6/2001 Nisi et al.

*Primary Examiner*—Robert C. Watson
(74) *Attorney, Agent, or Firm*—Fliesler Dubb Meyer & Lovejoy LLP

(57) ABSTRACT

A compact, vacuum compatible motorized jack for supporting heavy loads and adjusting their positions is provided. The motorized jack includes: (a) a housing having a base; (b) a first roller device that provides a first slidable surface and that is secured to the base; (c) a second roller device that provides a second slidable surface and that has an upper surface; (d) a wedge that is slidably positioned between the first roller device and the second roller device so that the wedge is in contact with the first slidable surface and the second slidable surface; (e) a motor; and (d) a drive mechanism that connects the motor and the wedge to cause the motor to controllably move the wedge forwards or backwards. Individual motorized jacks can support and lift of an object at an angle. Two or more motorized jacks can provide tip, tilt and vertical position adjustment capabilities.

13 Claims, 3 Drawing Sheets

MOTORIZED SUPPORT JACK

This is a divisional of 09/568,611, files May 10, 2000, now U.S. Pat. No. 6,328,282.

This invention was made with Government support under Contract No. DE-AC04-94AL85000 by the U.S. Department of Energy to Sandia Corporation. The Government has certain rights to the invention.

FIELD OF THE INVENTION

This invention relates to tools for supporting and lifting objects, and more particularly, to a vacuum compatible motorized jack that is suited for aligning photolithographic equipment used in the manufacture of integrated circuits.

BACKGROUND OF THE INVENTION

In general lithography refers to processes for pattern transfer between various media. Projection lithography is a powerful and essential tool for microelectronics processing. FIG. 5 schematically depicts an apparatus for EUV lithography that comprises a radiation source 11, such as a synchrotron or a laser plasma source, that emits x-rays 12 into condenser 13 which in turn emits beam 14 that illuminates a portion of reticle or mask 15. The emerging patterned beam is introduced into the imaging optics 16 which projects an image of mask 15, shown mounted on mask stage 17, onto wafer 18 which is mounted on stage 19. Element 20, an x-y scanner, scans mask 15 and wafer 18 in such direction and at such relative speed as to accommodate the desired mask-to-image reduction. The positions of the various components of the projection lithography system must be adjusted from time to time to, among other things, account for long-term creep. Mechanisms must be in placed in the projection lithography system to accomplished this without incurring significant down time.

SUMMARY OF THE INVENTION

The present invention is directed to a compact motorized jack that can be employed in a vacuum system to support heavy loads and to adjust their positions. Specifically, in one embodiment, the invention is directed to a motorized jack for use in a vacuum environment that includes:

(a) a housing having a base;

(b) a first roller device that provides a first slidable surface and that is secured to the base;

(c) a second roller device that provides a second slidable surface and that has an upper surface;

(d) a wedge that is slidably positioned between the first roller device and the second roller device so that the wedge is in contact with the first slidable surface and the second slidable surface;

(e) a motor; and (d) a drive mechanism that connects the motor and the wedge to cause the motor to controllably move the wedge forwards or backwards.

Individual motorized jacks can support and lift an object at an angle. Two or more motorized jacks can provide tip, tilt and vertical position adjustment capabilities.

DETAILED DESCRIPTION OF THE PREFERRED EMBODIMENTS

Figure 1:
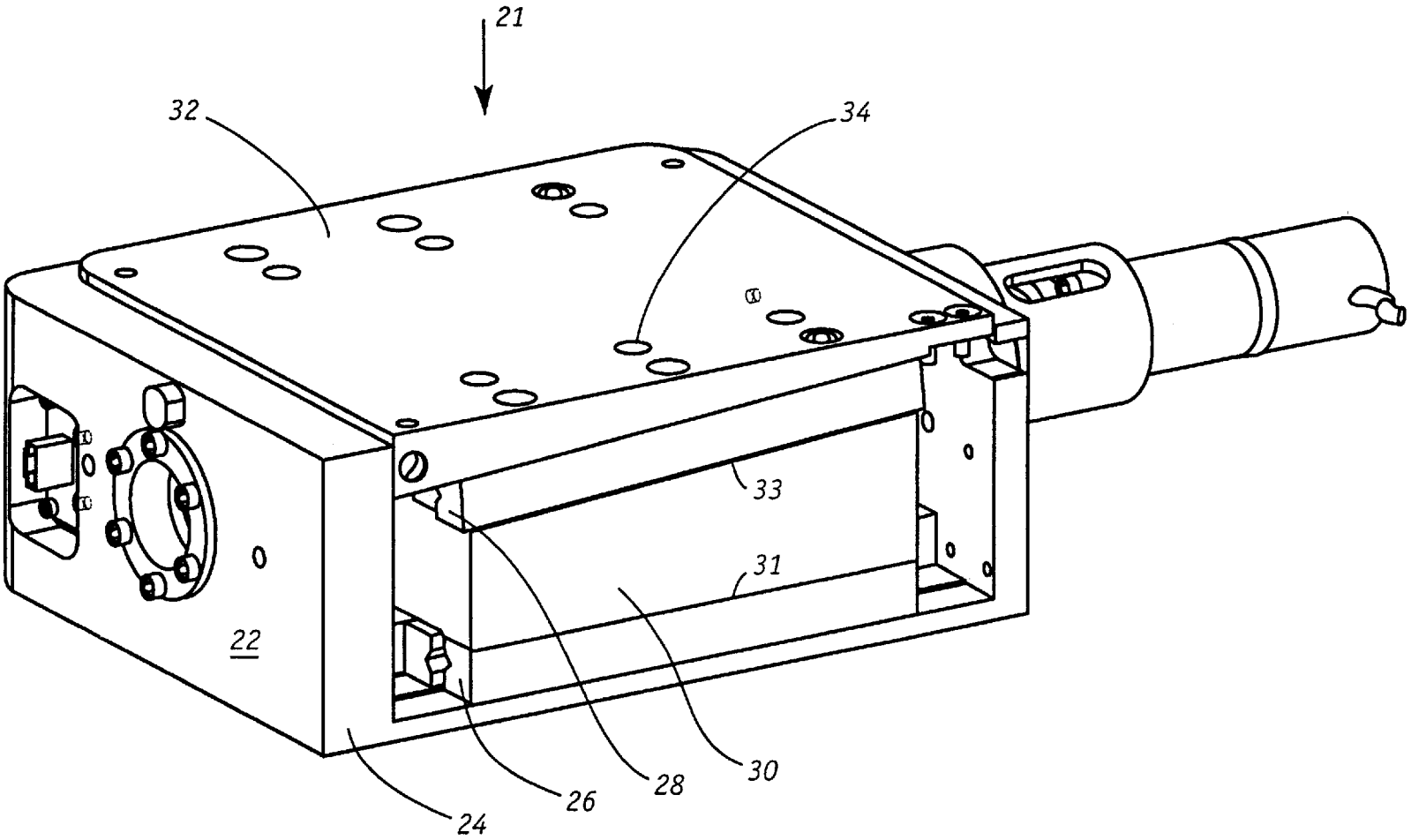
FIGS. 1 and 2 are prospective cross-sectional views of an embodiment of the motorized jack.

Referring to FIG. 1, the motorized jack assembly 21 includes a housing 22 that has a base 24. The housing encloses (1) a lower roller device 26 that is secured to the base 24, (2) an upper roller device 28, and (3) a wedge 30 that is positioned between the upper and lower roller devices. The roller devices permit the wedge to slide in and out in a linear motion with minimum friction. In this embodiment, the height of one side of the wedge is different from that of the other so that the lower surface 31 of the wedge is not parallel to the upper surface 33 of the wedge. The slope of the upper surface 33 can be designed to have a low or high grade. With a low grade the lifting of an object is more gradual. Typically, the upper surface 33 is from about 1 to 45 degrees from normal. The upper surface of upper roller device 28 is attached to a top platform 32 by screws that are inserted through the mounting holes 34. An object to be supported and moved rests on the platform. The wedge and roller devices can be fabricated from any suitable stable metal such as 416 stainless steel.

Figure 2:
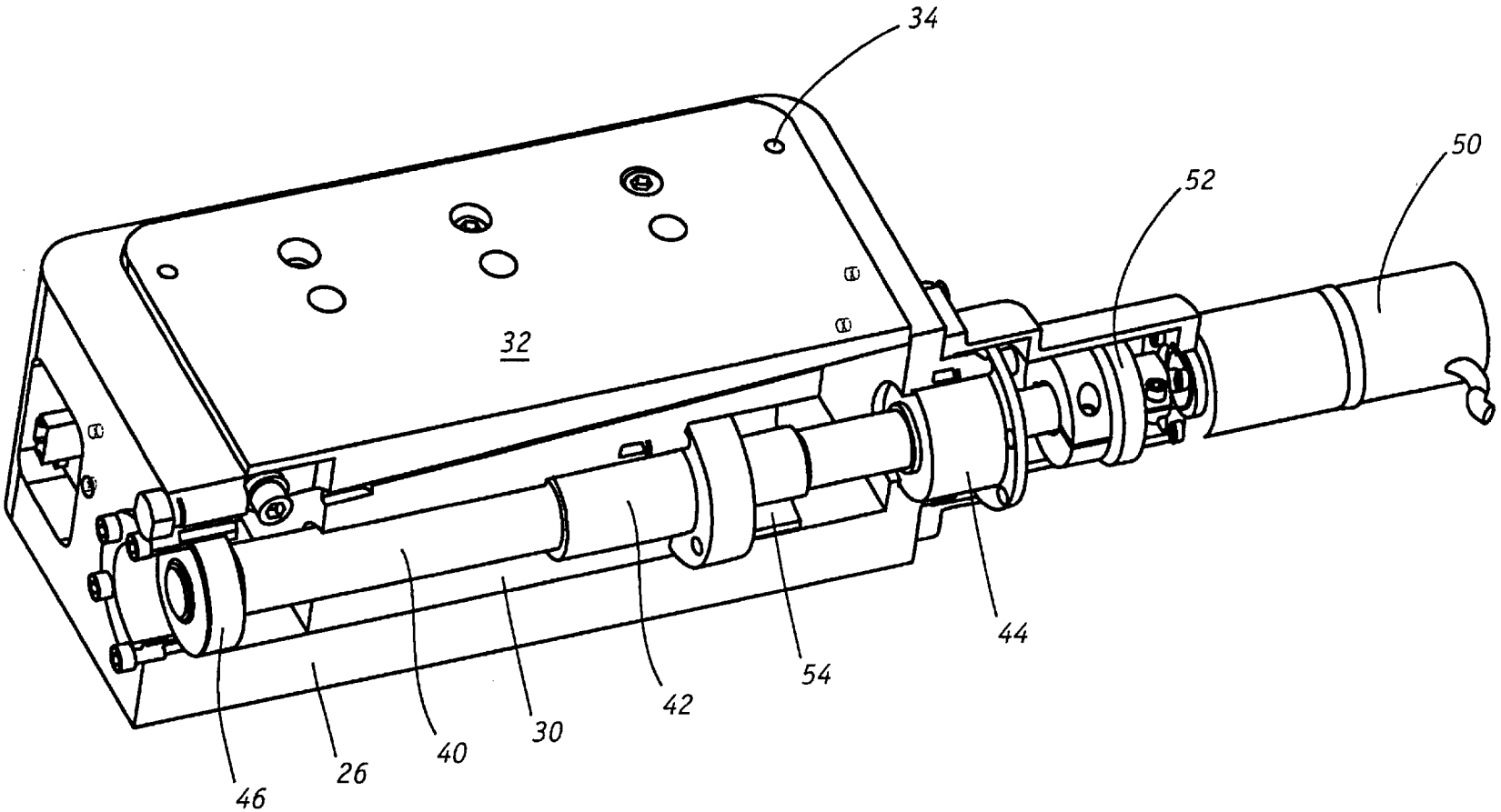

As shown in FIG. 2, the motorized jack includes an electric motor 50 that is connected to wedge 30 via a rotatable shaft (e.g., lead screw) 40. The lead screw 40 is connected to the motor 50 by coupler 52. The lead screw is supported by pilot bearing 46 and preload bearing 44. A lead screw nut 42 is secured to the lead screw 40 and the nut is disposed within cavity 54 in the wedge 30. In a preferred embodiment, the motor 50 is a stepper motor designed for 200 steps per revolution and has a 50:1 gearbox to drive a 1 mm lead pitch lead screw. In operation, activation of the motor and drive mechanism causes the wedge to move forward or backward. This movement raises or lowers the platform 32.

Figure 3:
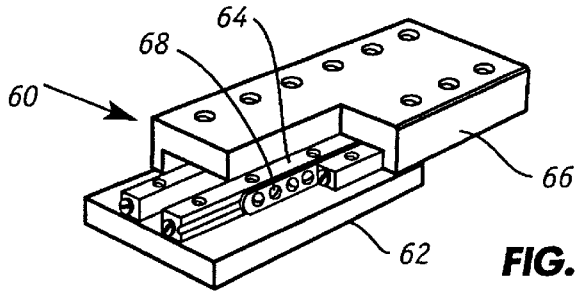
FIG. 3 is a perspective view of a crossed roller slide device.

In a preferred embodiment, the lower roller device 26 comprises a crossed roller rail that is secured to the base 24 and the upper roller device 28 comprises an upper movable crossed roller rail. Crossed roller rails are known in the art and are also referred to as crossed roller slide tables; a preferred embodiment is depicted in FIG. 3. Each crossed roller rail set 60 includes a base 62, one or more hardened steel linear bearings or rails 64, a metal carriage 66, and a plurality of rollers 68. The carriage moves in a direction that is parallel to the linear bearings. Depending on, among other things, the size of the motorized support jack desired, multiple sets of crossed roller rails can be employed. The crossed roller rails are particularly suited since they contribute to providing a low stiction, zero backlash, stiff motorized jack with the elimination of galling when operated in a vacuum environment.

As is apparent, the motorized support jack can be readily scaled to the proper size to meet different operating conditions such as the size and mass of the object to be supported and lifted and the degree of lift, tip, and/or tilt required. In addition, in one embodiment, the motorized jack is expected to be capable of raising or lowering objects that weigh between 1,000 lb. to 5,000 lb. or more in increments of ±1.5 mm with a resolution of 1 micron. Specifically, the lead screw can drive the wedge between the sets of crossed roller rails to provide a 1 mm to 5 mm vertical translation and preferably about a 3-mm vertical translation of the top platform. Optical limit switches can be positioned in the motorized jack to indicated the end of travel for the wedge and cap sensors can be employed to indicate the position of the object being supported and moved.

Another feature of the invention is that even when not activated, i.e., without motor power, the jack assembly will support an object essentially without deviating from its adjusted position. To provide tip/tilt and vertical position adjustment of an object that has a circular-shaped base, preferably three jacks each located 120 degrees apart are positioned to support the object. As is apparent, more jacks can be employed as necessary depending on the geometry of the object's base.

A motorized jack similar to that illustrated in FIGS. 1 and 2 was manufactured and tested. The vacuum stepping motor used was from Phytron, Inc. of Waltham, Mass., part no. VSS 32.20012-VGPL32/50-UHV-KTC. The lead screw used was from Universal Thread Grinding Co. of Fairfield, Conn. which included a modified ¾ inch diameter×1 mm pitch lead screw. Each of the lower and upper crossed roller rail consisted of 12 sets of crossed roller rails from PIC Design of Middlebury, Conn., part no. PNB6-150. The dimensions of the crossed roller rail set were 31 mm wide×15 mm thick×150 mm long. Each set comprised 6 mm diameter rollers that were rated at 1056 lb. load capacity. The pilot bearing used was from Barden Corp. of Danbury, Conn., part no. 202K3. The dimensions of the wedge were 7.5 in. wide, 5.7 in. long, and 3.0 in. thick at one end tapering down at 3.58 degrees (16:1 incline).

Figure 4:
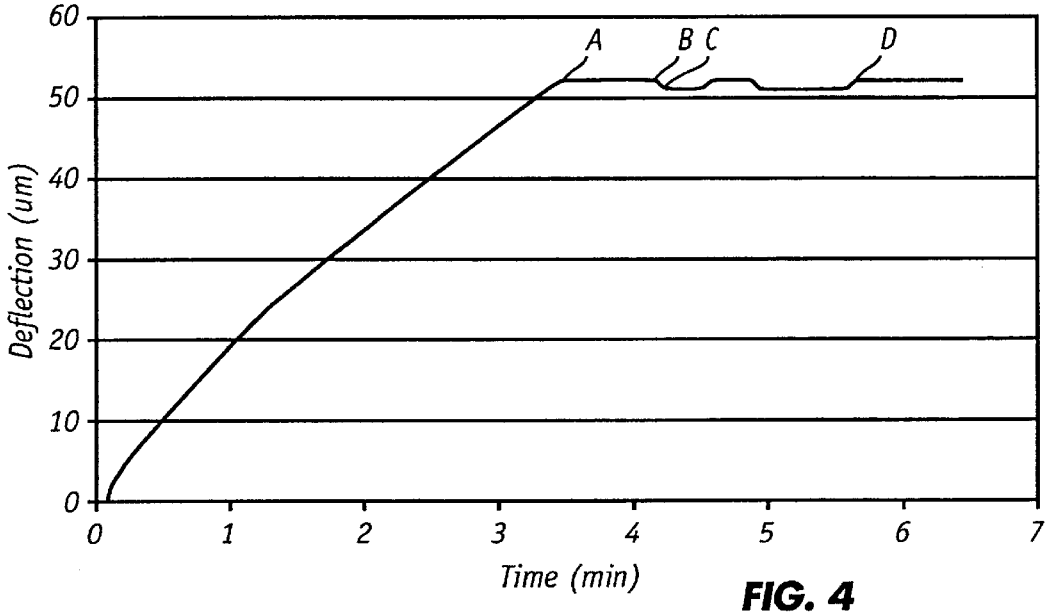
FIG. 4 is a graph of deflection vs. time illustrating the performance of the motorized jack.
Figure 5:
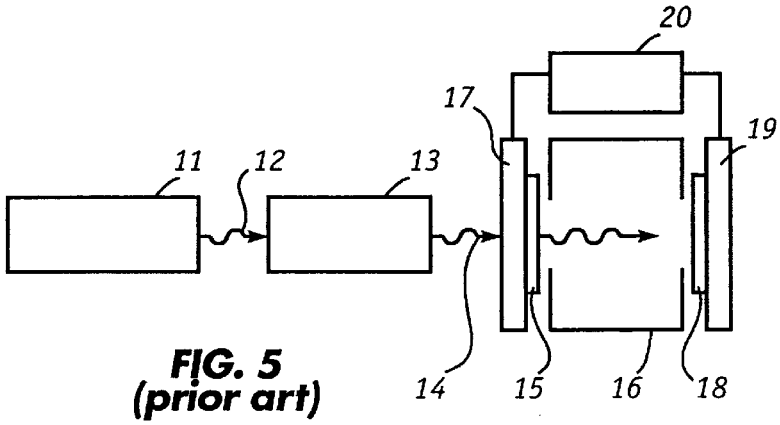
FIG. 5 (prior art)
FIG. 5 is a schematic diagram of a photolithography system.

The performance of the jack was tested by applying 700 pounds of constant force on platform of the jack while the jack was raised and lowered in 1-micron steps. To simulate the load, a machine equipped with a driven lead screw applied the downward force on the platform of the jack. The position height of the platform was measured using a temporary cap gauge sensor mounted on the jack. A graph indicating the results of the test is shown in FIG. 4. A load was gradually increased on the platform until a constant force of 700 pounds was reached. This load increase took slightly more than 3 minutes time which is indicated by position A in the graph. During the time duration between positions A and B, the platform remained stationary; at position B the stepping motor was activated sufficiently to cause the platform to be raised a distance of 1 micron until point C when it was deactivated. As shown, repeated activation and deactivation of the motor to move up or down in 1 micron steps continued until point D, slightly more than 5.5 minutes into the testing, at which time the test was terminated. As is apparent, during intervals when the motor was deactivated, the position of the platform did not change significantly despite the application of the constant 700 pound force.

Although only preferred embodiments of the invention are specifically disclosed and described above, it will be appreciated that many modifications and variations of the present invention are possible in light of the above teachings and within the purview of the appended claims without departing from the spirit and intended scope of the invention.

What is claimed is:

1. A method of adjusting the position of an object which comprises the steps of:

(a) providing at least one motorized jack wherein each jack comprises:
  (i) a housing having a base;
  (ii) a first roller device that provides a first slidable surface and that is secured to the base;
  (iii) a second roller device that provides a second slidable surface and that has an upper surface;
  (iv) a wedge that is slidably positioned between the first roller device and the second roller device so that the wedge is in contact with the first slidable surface and the second slidable surface;
  (v) a motor; and
  (vi) a drive mechanism that connects the motor and the wedge to cause the motor to controllably move the wedge forwards or backwards;

(b) placing the object on the upper surface of the second roller device; and (c) activating the motor to adjust the position of the object by raising or lowering the object.

2. The method of claim 1 wherein step (c) comprises raising or lowering the object in increments of about 1.5 mm.

3. The method of claim 1 further comprising the step of deactivating the motor whereby the object remains essentially at its adjusted position after the motor is deactivated.

4. The method of claim 1 wherein activating the motor in step (c) causes a rotatable shaft in the drive mechanism to rotate and thereby raise or lower the object.

5. The method of claim 1 wherein the activating the motor in step (c) causes a rotatable shaft which is supported by bearings in the drive mechanism to rotate and thereby raise or lower the object.

6. The method of claim 5 wherein activating the motor in step (c) causes a drive nut which is connected to the rotatable shaft to engage the wedge.

7. The method of claim 6 wherein step (a) comprises providing at least one motorized jack wherein each jack has a wedge that defines a cavity and the drive nut is disposed within the cavity.

8. The method of claim 1 wherein step (a) comprises providing at least one motorized jack wherein each jack has is an electric stepper motor.

9. The method of claim 1 wherein step (a) comprises providing at least one motorized jack wherein each jack has a first roller device that comprises a first crossed roller rail and the second roller device comprises a second crossed roller rail.

10. The method of claim 1 wherein step (a) comprises providing at least one motorized jack wherein each jack further comprises a platform that is attached to the second crossed roller rail.

11. The method of claim 1 wherein step (a) comprises of employing at least three motorized jacks that support the object and step (c) comprises of activating one or more of the at least three motorized jacks.

12. The method of claim 11 further comprising the step of deactivating the motors of each of the at least three motorized jacks whereby the object remains essentially at its position after the motors are deactivated.

13. The method of claim 11 wherein step (c) comprises of activating all the motorized jacks to raise or lower the object in an essentially vertical direction.

* * * * *